United States Patent [19]

Lee

[11] 3,971,320

[45] July 27, 1976

[54] ELECTRIC INITIATOR

[75] Inventor: John T. M. Lee, Phoenixville, Pa.

[73] Assignee: ICI United States Inc., Wilmington, Del.

[22] Filed: Apr. 5, 1974

[21] Appl. No.: 458,360

[52] U.S. Cl. ..... 102/28 R
[51] Int. Cl.[2] ..... F42B 3/12
[58] Field of Search ..... 102/28, 28 M, 46

[56] References Cited

UNITED STATES PATENTS

| | | | |
|---|---|---|---|
| 2,696,191 | 12/1954 | Sheehan | 102/46 X |
| 3,082,691 | 3/1963 | Evans et al. | 102/28 |
| 3,291,046 | 12/1966 | Dahl | 102/28 |
| 3,308,758 | 3/1967 | Stadler et al. | 102/28 |
| 3,426,682 | 2/1969 | Corren et al. | 102/28 |
| 3,429,260 | 2/1969 | Corren | 102/28 |

*Primary Examiner*—Verlin R. Pendegrass

[57] ABSTRACT

An electric initiator, such as a detonator, primer or squib, has a plastic case, a metallic inner cup, an explosive charge and a coaxial plug assembly which includes a conductive pin, a conductive sleeve surrounding the pin and spaced therefrom, an insulator which is bonded to both the pin and the sleeve, and a bridge wire connecting the two electrodes. The initiator also includes two lead wires, one welded or soldered to each electrode. This initiator is easy to assemble automatically and is highly resistant to accidental firing by static electricity.

5 Claims, 2 Drawing Figures

ELECTRIC INITIATOR

BACKGROUND OF THE INVENTION

This invention relates to electric initiators.

Electric initiators, or electro-explosive devices as they may also be called, are energy transducers which convert an electrical energy input into an explosive energy output. These devices include primers, detonators and squibs, which are structurally quite similar and differ from each other primarily in the level of explosive energy output.

Various types of electrical initiators are known in the art. One type has a metallic or plastic shell, an explosive charge and a pair of lead wires connected by a bridge wire or other bridge element. Devices of this type having a plastic shell or case are shown in various references including U.S. Pat. Nos. 2,802,421 and 2,996,987. Numerous references, including U.S. Pat. Nos. 2,086,532, 2,118,533 and 2,658,451, show two-lead initiators having a metallic shell. U.S. Pat. Nos. 3,128,703 and 3,173,367 disclose initiators of this type in which the shell can be either plastic or metallic. The initiator in U.S. Pat. No. 3,128,703 includes a shell and a shell liner, both of which can be made of either metallic or polymeric material. The bridge wire or other bridge element is usually connected directly to the ends of the two leads, although U.S. Pat. Nos. 722,913 and 1,590,364 show devices in which the bridge elements and the lead wires are connected to conductive metal strips.

Initiators having a single lead are also known. This type of initiator is fired by current flowing from the lead across a spark gap or through a bridge element to a grounded metallic shell or case. Devices of this type are illustrated, for example, in U.S. Pat. Nos. 2,921,520 and 2,964,835. These patents show a detonator plug assembly comprising a conductive pin and a coaxial conductive sleeve surrounding but insulated from the pin. The sleeve is in contact with a metallic shell or case. The pin and sleeve serve as terminals for the initiator. The device may have either a spark gap or a bridge element between the pin and the sleeve.

A two-lead initiator having a plastic shell is the safest of the above types of devices from the standpoint of risk of accidental initiation. One-lead devices are subject to accidental firing by either a short circuit or static discharge from the lead to the grounded shell. Short circuits are usually caused by a wire from another circuit touching the lead wire. Two-lead initiators having a metal shell are also susceptible to accidental initiation by static electricity, either by discharge from a lead to the shell or from shunted leads to the shell. The danger of accidental initiation from either static discharge or short circuit is greatly reduced in a plastic shell initiator of the two-lead type. However, this type of initiator has disadvantages. One is that lower pressures must be used in consolidating the explosive charge in a plastic shell device, because the plastic shell is ordinarily weaker than a metal shell. Another disadvantage of two-lead initiators generally, whether they have a plastic or metallic shell, is that they are difficult to assemble. Attachment of a bridge wire to the ends of two leads requires precise orientation of the bridge wire with respect to the leads while the leads are held in a fixed position. Handling and holding the lead wires in fixed position is cumbersome because of their length. Also, the bridge wire, which is of fine diameter, is easily broken or detached from one of the two leads during further assembly of the initiator.

SUMMARY AND OBJECTS

An object of this invention is to provide an electric initiator in which the danger of accidental firing by discharge of static electricity or by short circuits is minimized.

Another object of this invention is to provide an electric initiator which is easy to assemble.

The initiators of this invention comprise a nonconductive case and a metallic inner cup, both of which are open at one end and closed at the other end; a coaxial plug assembly which includes a conductive center pin, a conductive sleeve surrounding the pin but spaced from it, insulator means separating the pin from the sleeve, and a bridge element connecting the pin with the sleeve; a pair of lead wires extending through the open end of the case; means connecting one of the lead wires to the pin, and means connecting the other lead wire to the sleeve.

DRAWINGS

DESCRIPTION OF THE PREFERRED EMBODIMENT

Figure 1:
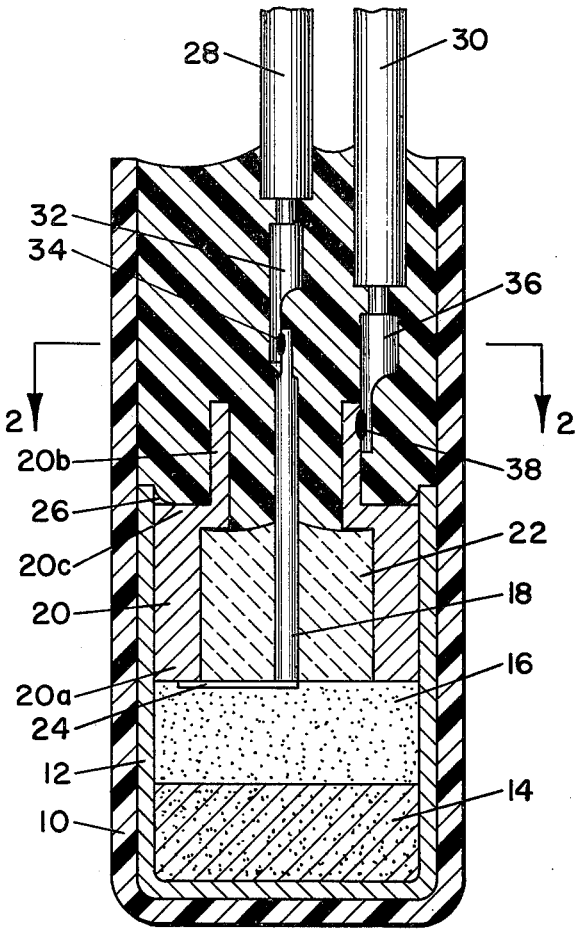
FIG. 1 is a longitudinal section of an initiator of this invention.

Referring to the drawing, the initiator has a nonconductive cup-shaped case 10, which is preferably made of a thermoplastic material or a thermosetting resin, e.g., polyethylene or phenolic resin. Case 10 is essentially cylindrical and is open at one end and closed at the other end. The initiator also has a cup-shaped metallic inner shell 12 of stainless steel, gilding metal or aluminum. The inner cup 12 is also essentially cylindrical with one closed end and one open end, and is disposed inside case 10 so that the open ends of each are in the same direction. Inner cup 12 serves as a liner which adds structural strength to the case.

The device contains an explosive charge within the case adjacent the closed end thereof. This charge is illustrated as a base charge 14 nearest the closed end of the case, and an igniter charge 16. The choice of explosive materials depends on whether the device is to be used as a primer, a detonator, or an igniter or squib. Suitable explosives and arrangements for each purpose are known in the art. For example, when the device is to be used as a detonator, a base charge of RDX (cyclonite) and an igniter charge of lead azide may be used.

The device also includes a coaxial electrode assembly comprising an elongated longitudinally extending conductive center pin 18 which lies along the center axis of the initiator; a sleeve 20 which surrounds and is coaxial with pin 18 but spaced from it and which preferably has two coaxial cylindrical portions **20*a* and 20*b* of different diameters and a shoulder 20*c* therebetween; a cylindrical insulator 22, preferably made of glass and alternatively made of other refractory, plastic, or elastomeric material, which has a central longitudinally extending opening for pin 18 and which fits snugly against both pin 18 and sleeve 20; and an electrically conductive bridge element, here shown as a bridge wire 24, which connects pin 18 with sleeve 20. The bridge wire is in proximity with the igniter charge 16. The larger diameter portion 20***a* of sleeve 20 is nearer the closed end of case 10 and is preferably in frictional engagement with inner cup 12. A sleeve consisting of a single tubular member of uniform diameter may be used in place of the sleeve 20 illustrated. A fusion seal 26 (solder or weld) may be provided between sleeve 20 and inner cup 12 in order to prevent access by moisture to the explosive charge. Alternatively, a seal of elastomeric material may be used; however, a fusion seal is preferred.

Figure 2:
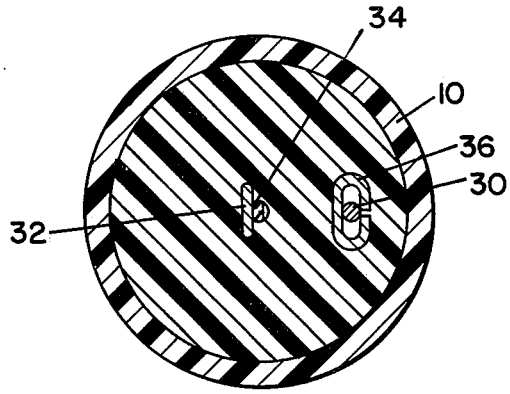
FIG. 2 is a cross section along line 2—2 of FIG. 1.

A pair of lead wires 28 and 30, which are covered by insulation except at their ends, are electrically connected to pin 18 and sleeve 20, respectively. The means connecting lead wire 28 to pin 18 comprises a crimped tab 32 which surrounds the end of wire 28, and a fusion joint 34, i.e., either a weld or solder joint (a resistance weld joint is preferred) which attaches tab 32 to pin 18. The means connecting lead wire 30 to sleeve 20 comprises a crimped tab 36 surrounding the end of wire 30, and a fusion joint (e.g., a resistance weld joint) 38 attaching tab 36 to the outer wall of the smaller portion 20*b* of sleeve 20. Tab 36 may be attached along the inner wall of sleeve 20, particularly if a sleeve of uniform diameter is used. Tabs 32 and 36 are seen edgewise in FIG. 1. They may be seen best in FIG. 2. Tabs 32 and 36 can be omitted, in which case leads 28 and 30 are welded directly to pin 18 and sleeve 20 respectively. The ends of wires 28 and 30 extend beyond the open end of case 10. Wires 28 and 30 are preferably stranded. The open end of case 10 is sealed by sealing or potting material 40, such as an epoxy resin, which adheres to the insulation on wires 28 and 30 and to the outer cup 10.

The device of the present invention may be assembled as follows: First, the base charge 14 is charged to the inner cup 12 and consolidated while the cup is held in fixed position. Then the igniter charge 16 is charged. A coaxial plug assembly comprising pin 18, sleeve 20, insulator 22, and bridge wire 24 is prepared by placing the pin, sleeve, and a sleeve-like glass preform in the desired coaxial configuration on a carbon surface, placing these members in a furnace which is maintained at a temperature of about 1900°F., at which temperature the glass becomes semi-molten, and then removing the coaxial subassembly from the furnace and allowing it to cool. The metal and glass are selected so that the metal sleeve 20 contracts more than glass insulator sleeve 22, forming a tight glass-to-metal seal between pin 18, sleeve 20, and insulator 22. The bridge wire 24 is then welded (preferably automatically) to the pin 18 and sleeve 20. Preferably the entire coaxial assembly operation is carried out on a moving conveyor belt which passes through a furnace. The completed coaxial assembly is then placed in the inner cup 12; this consolidates the igniter charge 16. The sleeve 20 is then sealed to inner cup 12, e.g., by soldering. The two lead wires 28 and 30 are then attached, preferably by resistance welding tabs 32 and 38 to pin 18 and sleeve 20, respectively. A close tolerance between the outer wall of sleeve 20 and the inner wall of inner cup 12 aids in keeping the coaxial plug assembly in position while seal 26 is formed and while the lead wires are attached. Also, lead wire 30 or its associated tab 38 can be attached to sleeve 20 at any point; no particular orientation relative to bridge wire 24 is required. Next, the outer cup 10 is placed in position. Finally, the open end of cup 10 is sealed with a potting or sealing material 40, which may be a conventional two-part epoxy resin that hardens on standing at room temperature.

The device of the present invention is particularly useful as a detonator for air bags in automobiles. This device may also be used as a detonator, primer, or igniter in other applications, such as various munitions, spacecraft, missiles, etc.

The initiators of the present invention have the combined advantages of safety, ruggedness, ease of assembly, and long life. Grounding of the case is avoided by use of a nonconductive case. This minimizes the risk of accidental firing due to a short circuit. This is important when the device is used in an automobile (e.g., in an automobile air bag), where there is a high risk of contact between the lead wires and other wiring. Accidental initiation by discharge of static electricity from either a lead wire or from shunted lead wires to the case is avoided. The initiators of this invention have the desirable safety characteristics of plastic shell initiators of the prior art, while at the same time they are more rugged, longer lived, and easier to assemble. The metal inner shell reinforces the plastic case and imparts ruggedness. The construction of this invention makes it possible to provide a hermetic fusion seal between sleeve 20 and metallic inner cup 12; such a seal is very unlikely to be broken, so that the initiator will remain operative for years. This is important in an automobile air bag, when the life of the initiator should equal or exceed the life of the car.

A major advantage of the instant device is ease of assembly. The coaxial electrode assembly of the present invention offers several advantages. First, it is easier to weld a bridge wire automatically to the ends of a pair of coaxial electrodes, i.e., the bridge can be placed at any angle, thus the electrode assembly does not have to be angularly oriented. The lead wires are attached during the latter stages of assembly which is advantageous. This facilitates handling during bridging and plug insertion and final assembly. Stranded lead wires, which are less sensitive to bending than nonstranded wires can be used in the present device. It is difficult, if not impossible, to seal stranded wires directly to a glass insulator such as insulator 22 herein, but stranded wires can be readily welded to the pin 18 and sleeve 20. The two lead wires do not have to be in any particular orientation with respect to each other, since sleeve 20 completely encircles pin 18. The initiators of the present invention are much easier to assemble than two-lead initiators presently known in the art. In summary, the initiators of the present invention combine the safety features of plastic shell initiators with an ease of assembly not heretofore achieved with two-lead initiators.

What is claimed is:

1. An electric initiator comprising:

a. a cup-shaped nonconductive cylindrical outer case open at one end and closed at the other end;

b. a cylindrical metallic inner cup open at one end and closed at the other end, said cup being of one piece construction comprising a cylindrical wall and an end wall at one end, the thickness of the end wall being at least as great as the thickness of the cylindrical wall, the open ends of said nonconductive case and said inner cup being oriented in the same direction, said outer case completely surrounding the side and closed end of said inner cup so as to prevent accidental grounding of said inner cup;

c. an explosive charge within said inner cup;

d. a coaxial plug assembly within said inner cup adjacent to said explosive charge, said assembly comprising 1. an elongated, longitudinally extending conductive center pin;
2. a conductive sleeve surrounding said pin and coaxial therewith but spaced therefrom, said conductive sleeve being in engagement with said inner cup,
3. a refractory insulator separating said pin from said sleeve, said insulator forming refractory-to-metal seals with said pin and said conductive sleeve, and
4. a bridge element connecting said pin with said sleeve, said bridge element being in proximity with said explosive charge;

e. means forming a moisture proof seal between said inner cup and said sleeve;

f. a pair of lead wires extending through the open end of said case;

g. means connecting one of said lead wires to said pin;

h. means connecting the other of said lead wires to said sleeve; and i. potting material sealing the open end of said case.

2. An initiator according to claim 1 in which said sleeve has two cylindrical portions of different diameters and a shoulder therebetween, the portion of larger diameter being nearer the closed end of said case.

3. An initiator according to claim 1 in which the ends of the center pin and the conductive sleeve nearest the closed ends of said outer case and said inner cup are essentially coplanar and in which said bridge element is connected to said ends of said center pin and said sleeve.

4. An initiator according to claim 1 in which said insulator is glass.

5. An initiator according to claim 1 in which said moisture proof seal is a fusion seal.

* * * * *